US007642924B2

(12) United States Patent
Andres et al.

(10) Patent No.: US 7,642,924 B2
(45) Date of Patent: Jan. 5, 2010

(54) ALARM WITH CO AND SMOKE SENSORS

(75) Inventors: John J. Andres, Chapel Hill, NC (US); Stanley D. Burnette, Colorado Springs, CO (US); David A. Bush, Colorado Springs, CO (US)

(73) Assignee: Walter Kidde Portable Equipment, Inc., Mebane, NC (US)

( * ) Notice: Subject to any disclaimer, the term of this patent is extended or adjusted under 35 U.S.C. 154(b) by 320 days.

(21) Appl. No.: 11/713,295

(22) Filed: Mar. 2, 2007

(65) Prior Publication Data

US 2008/0211678 A1 Sep. 4, 2008

(51) Int. Cl.
*G08B 17/10* (2006.01)

(52) U.S. Cl. ..... 340/628; 340/522; 340/506

(58) Field of Classification Search ..... 340/628–630, 340/521–523, 577, 579, 511, 506
See application file for complete search history.

(56) References Cited

U.S. PATENT DOCUMENTS

| | | | | |
|---|---|---|---|---|
| 4,383,251 | A * | 5/1983 | Perelli et al. | 340/527 |
| 4,688,021 | A | 8/1987 | Buck et al. | |
| 4,871,999 | A | 10/1989 | Ishii et al. | |
| 4,975,684 | A | 12/1990 | Guttinger et al. | |
| 5,084,696 | A * | 1/1992 | Guscott et al. | 340/541 |
| 5,159,315 | A | 10/1992 | Schultz et al. | |
| 5,168,262 | A | 12/1992 | Okayama | |
| 5,172,096 | A | 12/1992 | Tice | |
| 5,376,924 | A | 12/1994 | Kubo et al. | |
| 5,471,194 | A | 11/1995 | Guscott | |
| 5,523,743 | A | 6/1996 | Rattman et al. | |
| 5,552,763 | A | 9/1996 | Kirby | |
| 5,557,262 | A | 9/1996 | Tice | |
| 5,592,147 | A | 1/1997 | Wong | |
| 5,691,703 | A | 11/1997 | Roby et al. | |
| 5,691,704 | A | 11/1997 | Wong | |
| 5,767,776 | A | 6/1998 | Wong | |
| 5,798,700 | A | 8/1998 | Wong | |
| 5,801,633 | A | 9/1998 | Soni | |
| 5,831,537 | A | 11/1998 | Marman | |
| 5,945,924 | A | 8/1999 | Marman et al. | |
| 5,966,077 | A | 10/1999 | Wong | |
| 5,969,604 | A | 10/1999 | Tice | |
| 6,057,549 | A | 5/2000 | Castleman | |

(Continued)

FOREIGN PATENT DOCUMENTS

EP 0418410 A1 3/1991

(Continued)

OTHER PUBLICATIONS

International Search Report for International Patent Application No. PCT/US08/02617 mailed Jun. 24, 2008.

(Continued)

*Primary Examiner*—Daniel Wu
*Assistant Examiner*—Hongmin Fan
(74) *Attorney, Agent, or Firm*—Kinney & Lange, P.A.

(57) ABSTRACT

A life safety device includes a smoke sensor and a carbon monoxide (CO) sensor. Smoke sensitivity of the device is adaptively adjusted based upon the smoke sensor signal and the CO sensor signal.

20 Claims, 2 Drawing Sheets

U.S. PATENT DOCUMENTS

| | | | | |
|---|---|---|---|---|
| 6,064,064 | A | 5/2000 | Castleman | |
| 6,107,925 | A * | 8/2000 | Wong | 340/628 |
| 6,153,881 | A | 11/2000 | Castleman | |
| 6,166,647 | A | 12/2000 | Wong | |
| 6,229,439 | B1 | 5/2001 | Tice | |
| 6,346,880 | B1 | 2/2002 | Schroeder et al. | |
| 6,392,536 | B1 | 5/2002 | Tice et al. | |
| 6,426,703 | B1 | 7/2002 | Johnston et al. | |
| 6,515,283 | B1 | 2/2003 | Castleman et al. | |
| 6,518,574 | B1 | 2/2003 | Castleman | |
| 6,597,288 | B2 | 7/2003 | Amano et al. | |
| 6,753,786 | B1 * | 6/2004 | Apperson et al. | 340/628 |
| 6,788,197 | B1 | 9/2004 | Thuillard et al. | |
| 6,788,198 | B2 | 9/2004 | Harshaw | |
| 6,856,252 | B2 | 2/2005 | Pfefferseder et al. | |
| 6,897,774 | B2 | 5/2005 | Costa et al. | |
| 6,956,473 | B2 | 10/2005 | Hanood | |
| 6,967,582 | B2 | 11/2005 | Tice et al. | |
| 6,979,260 | B2 * | 12/2005 | Liu | 454/255 |
| 7,019,657 | B2 | 3/2006 | Lovell et al. | |
| 7,034,701 | B1 | 4/2006 | Rose-Pehrsson et al. | |
| 7,142,105 | B2 | 11/2006 | Chen | |
| 7,319,403 | B2 | 1/2008 | Woodard et al. | |
| 7,327,247 | B2 * | 2/2008 | Tice | 340/511 |
| 7,336,168 | B2 | 2/2008 | Kates | |
| 7,528,711 | B2 | 5/2009 | Kates | |
| 7,532,117 | B2 | 5/2009 | Barrieau et al. | |
| 2002/0118116 | A1 | 8/2002 | Tice et al. | |
| 2005/0200492 | A1 * | 9/2005 | Woodard et al. | 340/632 |
| 2006/0273896 | A1 | 12/2006 | Kates | |
| 2007/0030156 | A1 | 2/2007 | Schlager et al. | |
| 2009/0051552 | A1 | 2/2009 | Chabanis et al. | |

FOREIGN PATENT DOCUMENTS

| | | |
|---|---|---|
| WO | WO 96/41318 | 12/1996 |
| WO | WO 97/27571 | 7/1997 |
| WO | WO 2006/131204 | 12/2006 |

OTHER PUBLICATIONS

Written Opinion of the International Search Authority for International Patent Application No. PCT/US08/02617 mailed Jun. 24, 2008.

Article entitled, "Carbon Monoxide Fire Detector", Tyco Fire & Security, Technical Datasheet, pp. 1-4.

Fischer, A., Muller, C.; A stimulation technique for the design of multi sensor based fire detection algorithms; Proceedings of the 10th International Conference on Automatic Fire Detection AUBE '95 in Duisburg, Germany; Apr. 1995; ISBN 3-930911-46-9.

Dipl-Ing. Rainer, Siebel, Strategies for the Development of Detection Algorithms, Proceedings of the 12th International Conference on Automatic Fire Detection, AUBE '01, in Duisburg, Germany; Nov. 20, 2000.

* cited by examiner

ALARM WITH CO AND SMOKE SENSORS

BACKGROUND OF THE INVENTION

This invention relates to life safety devices that include both a carbon monoxide (CO) sensor and a smoke sensor. In particular, the invention relates to improvements that enhance detection of fires and help to eliminate false alarms.

Smoke detectors, carbon monoxide detectors, and units that combine both smoke detection and carbon monoxide detection have found widespread use in residences and in commercial buildings. Smoke detectors provide early warning of fires, while carbon monoxide detectors can warn occupants of the buildup of deadly carbon monoxide that may be produced, for example, by a malfunctioning heating system, a wood burning stove or a fireplace.

Two types of smoke sensors are in common use: ionization smoke sensors and photoelectric smoke sensors. Ionization smoke sensors typically work better in detecting fast flaming fires, while photoelectric smoke sensors alarm more quickly to slow smoldering fires. Increasing the alarm threshold of an ionization smoke sensor can yield better sensitivity to slow smoldering fires, but the increased sensitivity tends to result in more false alarms.

There are some conditions under which a smoke detector can generate an alarm when no fire exists. Common examples of these types of false alarms are alarms triggered by cooking particles or smoke generated during the cooking of food. Another example is a false alarm triggered by shower steam that reaches a smoke detector. Alarms generated under these conditions are a nuisance and can also result in alarms being given less attention than they deserve when a real fire occurs.

BRIEF SUMMARY OF THE INVENTION

A life safety device having a combination of a smoke sensor and a carbon monoxide sensor offers a reduction in false alarms through the use of an adaptively adjustable smoke alarm sensitivity. When the smoke sensor signal indicates presence of smoke at a smoke alarm threshold level, the smoke alarm threshold is adjusted to decrease smoke sensitivity. An alarm will be generated if the CO sensor signal indicates presence of carbon monoxide, or the smoke sensor signal indicates an increase in smoke to the adjusted alarm threshold, or the smoke sensor indicates continued presence of smoke at the initial smoke alarm threshold at the end of a timeout period. If the CO sensor signal indicates presence of carbon monoxide before the smoke sensor signal indicates presence of smoke, the smoke alarm threshold is adjusted to increase smoke sensitivity.

DETAILED DESCRIPTION

Figure 1:
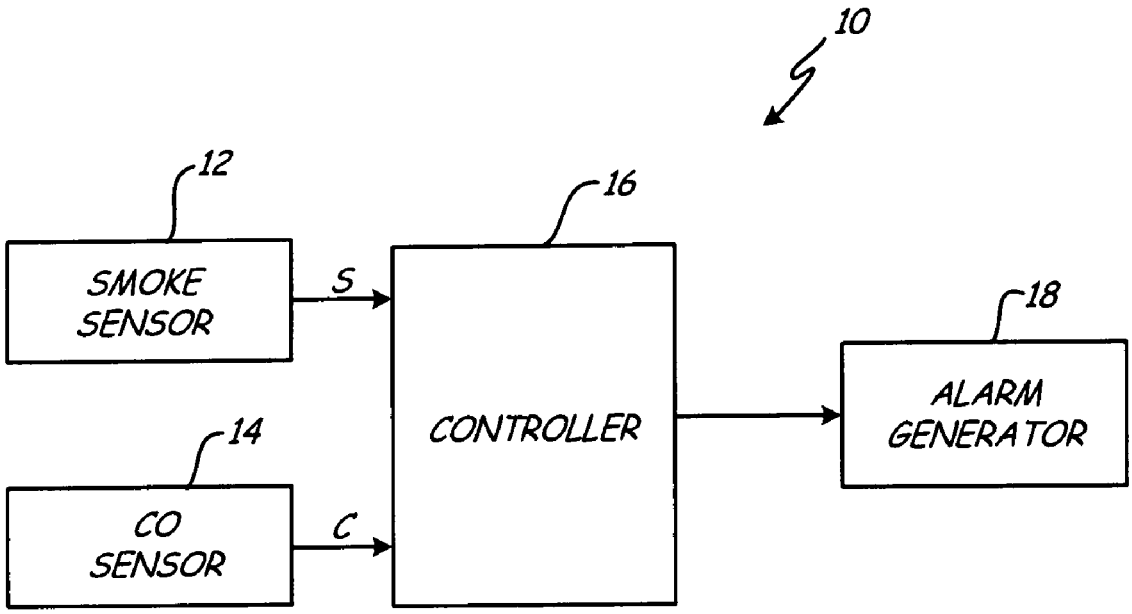
FIG. 1 is a block diagram of a combination life safety device including a smoke sensor and a carbon monoxide sensor.

FIG. 1 shows life safety device 10, which is a combination device including smoke sensor 12, carbon monoxide (CO) sensor 14, controller 16, and alarm generator 18. Device 10 is a dual function device, which, in one embodiment provides a smoke alarm in response to a buildup of smoke and CO indicating a fire, and a CO alarm in response to a buildup of carbon monoxide indicating a potentially life threatening level of poisonous gas. In another embodiment, device 10 is a single function device in which only the smoke alarm function is provided.

Smoke sensor 12 is an ionization smoke sensor that produces a smoke sensor signal S that is a voltage that varies as a function of smoke particles. As the number of smoke particles present in the ionization chamber of smoke sensor 12 increases, the voltage of smoke sensor signal S decreases.

CO sensor 14 may be a conventional CO sensor. The output of CO sensor 14 is CO sensor signal C. For example, in one embodiment CO sensor signal C is a current that varies nearly linearly as a function of parts per million of carbon monoxide molecules sensed by CO sensor 14. CO sensor signal C increases with increasing concentration of CO molecules.

Controller 16 is a microprocessor-based control that makes determinations of whether to activate alarm generator 18 based upon smoke sensor signal S and CO sensor signal C. In one embodiment, as a true combination alarm, in the case of CO detection, controller 16 maintains a carbon monoxide alarm threshold COT. When the integrated CO sensor signal C reaches alarm threshold COT, controller 16 causes alarm generator 18 to produce a CO alarm.

In the case of smoke/fire detection (in either a dual function or single function embodiment), controller 16 uses both smoke sensor signal S and CO sensor signal C as a part of the smoke alarm determination. Controller 16 uses a CO/smoke alarm threshold CT and an adjustable smoke alarm threshold ST to make a determination of whether to cause alarm generator 18 to produce a smoke alarm.

One problem encountered with smoke detectors is a tendency to generate a false alarm as a result of cooking particles or smoke generated during cooking. Other sources of false alarms can be hot water running in a shower that generates steam, and dust particles. Cooking particles, steam, and dust particles can cause a change in the output of smoke sensor 12 and potentially cause a false alarm.

The use of an adjustable smoke alarm threshold ST, which changes sensitivity to smoke based upon both smoke sensor signal S and CO sensor signal C, can reduce false alarms while increasing the ability of device 10 to detect slow smoldering fires. The adjustable smoke alarm threshold makes use of several observations. First, fast burning fires typically result in a fast buildup of smoke particles. Second, typical causes of false alarms (cooking, steam, and dust particles) normally do not generate much, if any, CO. Third, a smoldering fire will have both smoke and CO present in detectable amounts, with the CO/smoke alarm threshold CT being reached well before typical smoke alarm thresholds.

Figure 2:
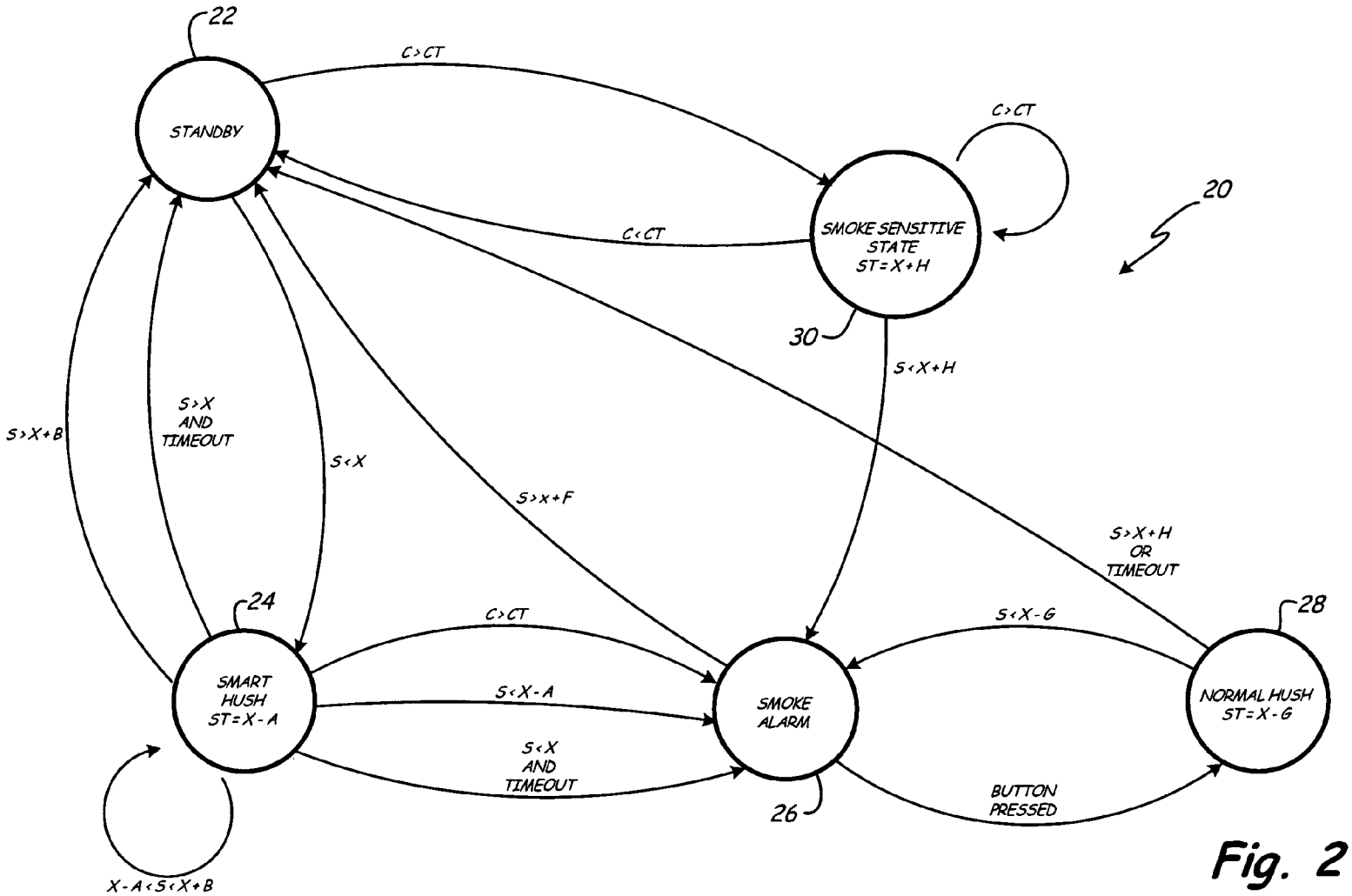
FIG. 2 is a state diagram showing how the smoke sensor and CO sensor are used by the controller of the life safety device of FIG. 1 to perform the smoke detection function.

FIG. 2 illustrates smoke alarm state diagram 20, showing the use by controller 12 of both smoke sensor signal S and CO sensor signal C in order to enhance the detection of fires, while avoiding false alarms from causes such as cooking particles, steam, and dust. FIG. 2 relates only to the smoke and fire detection function. Controller 16 also includes states (which are not illustrated in FIG. 2) related to carbon monoxide alarm generation using only CO sensor signal C and CO alarm threshold COT.

Smoke alarm state diagram 20 includes five states: Normal Standby state 22, Smart Hush state 24, Smoke Alarm state 26, Normal Hush state 28, and Smoke Sensitive state 30. As long as signal S from smoke sensor 12 and signal C from CO sensor 14 do not indicate a fire or a carbon monoxide danger, controller 16 remains in standby state 22.

If smoke sensor 12 senses smoke particles so that smoke sensor voltage S is less than a calibrated initial threshold X, controller 16 transitions from Standby state 22 to Smart Hush state 24. Upon entering Smart Hush state 24, controller 16 lowers the current smoke threshold ST by a set amount, meaning that it will require more smoke to cause device 10 to go into alarm. In the example shown in FIG. 2, current smoke threshold ST is lowered from X (the initial threshold) to X−A.

Controller 16 will stay in the Smart Hush mode as long as smoke sensor 12 continues to sense some smoke, but CO sensor 14 has not sensed carbon monoxide at a level greater than the CO/smoke alarm threshold CT (which may be, for example, in a range of about 12 ppm to about 24 ppm). As shown in FIG. 2, controller 16 remains in the Smart Hush state 24 as long as smoke voltage S is greater than X−A and is less than X+B, and the CO signal C is less than CT.

Two conditions can cause controller 16 to return to Standby state 22 from Smart Hush state 24 without any alarm having been generated. First, if during the timeout period the level of smoke has decreased so that smoke voltage S is greater than X+B, controller 16 returns to Standby state 22. Second, if at the end of a timeout period (e.g. about 8 minutes), the smoke level has decreased so that the smoke sensor voltage S is greater than the initial threshold ST=X, controller 16 will return to Standby state 22. In either case, the change in smoke level during the timeout period indicates a temporary situation, caused, for example, by cooking food, rather than by a fire.

While controller 16 is in the Smart Hush state 24, controller 16 continues to look for two events that indicate a fire condition: (a) continued buildup of smoke or (b) presence of carbon monoxide above the CO/smoke alarm threshold level (CT). As shown in FIG. 2, if smoke continues to build up so that smoke signal S is less than X−A, controller 16 switches to the Smoke Alarm state and causes alarm generator 18 to generate a smoke alarm. With a typical fast burning fire, the buildup of smoke and CO is fast, and smoke signal S may reach adjusted threshold ST=X−A, within seconds after it reached original threshold ST=X. Thus the adjustment of smoke alarm threshold ST to reduce sensitivity once smoke is present does not significantly alter the ability to detect a fast burning fire.

If CO sensor 14 senses more than threshold level CT of carbon monoxide (C>CT) during Smart Hush state 24, controller 16 enters the Smoke Alarm state 26 and causes alarm generator 18 to produce a smoke alarm. If smoke particles are present so that sensor signal S is between X−A and X+B, and carbon monoxide is sensed at or beyond threshold level CT during Smart Hush state 24, this indicates that a fire is present, and not just a cooking problem, dust, or steam from a shower. Carbon monoxide is always present in real fires. Although some carbon monoxide is present when foods are burned or cooked well done, the level of carbon monoxide is usually at amounts that are below threshold level CT. Therefore, when device 10 senses more than level CT of carbon monoxide at the same time that it is sensing smoke particles, there is a basis for generating the smoke alarm.

If smoke sensor signal S is less than X at the end of the timeout, the smoke particles have not dissipated during the Smart Hush period defined by the timeout. Controller 16 transitions to the Smoke Alarm state 26 and causes alarm generator 18 to generate the smoke alarm.

Once controller 16 is in Smoke Alarm state 26, it will remain in that state until (a) smoke reduces to the level where smoke signal S is greater than X+F (which causes a transition to Normal Standby state 22) or (b) a reset button is pushed (causing a transition to Normal Hush state 28).

When Normal Hush state 28 is active, the current smoke threshold is reduced further to ST=X−G. The alarm generated by alarm generator 18 is silenced as a result of a reset button pressed and will remain silenced during the Normal Hush state 28 until smoke voltage S is greater than X+F (indicating smoke has dissipated), or a timeout of the Normal Hush period has occurred, whichever is earlier. In either case, controller 16 will return to Standby state 22.

If smoke continues to build up so that smoke sensor signal S decreases to the point where S is less than X−G, controller 16 exits Normal Hush state 28 and returns to Smoke Alarm state 26. Upon reentry in Smoke Alarm state 26, controller 16 again activates alarm generator 18.

In some cases, carbon monoxide at a level greater than threshold CT could be sensed by CO sensor 14 before smoke has built up to the point where smoke sensor signal S reaches initial threshold level ST=X. In that case, controller 16 will transition from Standby state 22 to Smoke Sensitive state 30. While in Smoke Sensitive state 30, controller 16 increases smoke threshold ST above the initial threshold to ST=X+H. Since smoke voltage S decreases as smoke increases, the increase in smoke threshold ST makes controller 16 more sensitive to the presence of smoke. If smoke is present at a level so that S is less than X+H, controller 16 will transition to Smoke Alarm state 26.

As long as the amount of smoke does not satisfy the more sensitive threshold ST=X+H, controller 16 remains in Smoke Sensitive state 30 as long as carbon monoxide signal C is greater than CT. As soon as the carbon monoxide level decreases below threshold CT, controller 16 returns to Standby state 22.

Adjustments A, B, F, G, and H to smoke threshold ST are voltage adjustments that correspond to a sensitivity adjustment in picoAmps on the sensitivity scale used by Underwriters Laboratories (UL) to test and characterize sensitivity of smoke detectors. In one embodiment, A is a sensitivity adjustment of 7.0 picoAmps; B is a sensitivity adjustment of 3.5 picoAmps; F is a sensitivity adjustment of 7.0 picoAmps; G is a sensitivity adjustment of 14.0 picoAmps; and H is a sensitivity adjustment of 7.0 picoAmps. In other embodiments, some or all of the adjustments may differ from these values.

Ionization smoke sensors typically work better in detection of fast flaming fires, while photoelectric smoke sensors tend to work better with slow smoldering fires. By using carbon monoxide sensor 14 as part of the smoke alarm determination, and adaptively adjusting smoke alarm threshold ST, as illustrated in FIG. 2, the performance of a combination ionization smoke sensor and carbon monoxide sensor can match the performance of photoelectric smoke sensors in detecting smoldering fires, while still maintaining the superior performance of the ionization smoke sensor in detecting fast flaming fires and without generating a higher number of false alarms.

Although the present invention has been described with reference to preferred embodiments, workers skilled in the art will recognize that changes may be made in form and detail without departing from the spirit and scope of the invention.

What is claimed is:

1. A life safety device comprising:

a smoke sensor for producing a smoke sensor signal;

a carbon monoxide (CO) sensor for producing a CO sensor signal; and a controller for controlling generation of a smoke alarm based upon the smoke sensor signal and the CO sensor signal, the controller increasing sensitivity to the smoke sensor signal if the CO sensor signal reaches a CO/smoke threshold before the smoke sensor signal reaches an initial smoke threshold, and wherein the controller causes a smoke alarm to be generated if, after sensitivity to the smoke sensor signal is increased, the smoke sensor signal reaches an increased sensitivity threshold.

2. The life safety device of claim 1, wherein the controller decreases sensitivity to the smoke sensor signal when the smoke sensor signal reaches the initial smoke threshold before the CO sensor reaches the CO/smoke threshold.

3. The life safety device of claim 2, wherein the controller causes a smoke alarm to be generated if the smoke sensor signal reaches a decreased sensitivity threshold.

4. The life safety device of claim 2, wherein the controller causes a smoke alarm to be generated if the smoke sensor signal is at or beyond the initial smoke threshold at expiration of a timeout period.

5. The life safety device of claim 2, wherein the controller causes a smoke alarm to be generated if, after sensitivity to the smoke sensor signal is decreased, the CO sensor signal reaches the CO/smoke threshold.

6. The device of claim 1, where the controller enters a Smart Hush state when the smoke sensor signal reaches the initial smoke threshold, in which the controller causes a smoke alarm to be generated if (a) the CO sensor signal reaches a CO/smoke threshold, (b) the smoke sensor signal reaches an adjusted smoke threshold, or (c) the smoke sensor signal has reached the initial smoke threshold at an end of a timeout period.

7. A method of detecting fires, the method comprising:

comparing a smoke sensor signal to a smoke alarm threshold;

comparing a carbon monoxide (CO) sensor signal to a CO/smoke threshold;

adjusting the smoke alarm threshold based upon the smoke sensor signal and the CO sensor signal, comprising increasing sensitivity to smoke if the CO sensor signal reaches the CO/smoke threshold; and generating a smoke alarm based upon the smoke sensor signal and the adjusted smoke alarm threshold.

8. The method of claim 7, wherein adjusting the smoke alarm threshold further comprises:

decreasing sensitivity to smoke if the smoke sensor signal reaches an initial smoke alarm threshold.

9. The method of claim 8, wherein generating a smoke alarm comprises:

generating a smoke alarm if the CO sensor signal reaches the CO/smoke threshold or the smoke sensor signal reaches the smoke alarm threshold as adjusted to decrease sensitivity.

10. The method of claim 7, wherein generating a smoke alarm comprises:

generating a smoke alarm if the smoke sensor signal reaches the smoke alarm threshold as adjusted to increase sensitivity.

11. A device comprising:

a first hazardous condition sensor for producing a first sensor signal;

a second hazardous condition sensor for producing a second sensor signal; and a controller producing a first alarm when the first sensor signal meets a first threshold and a second alarm when the second sensor signal meets a second threshold, and for adjusting the first threshold to change sensitivity of the controller to the first sensor signal as a function of the first sensor signal and the second sensor signal, wherein the controller increases sensitivity to the first sensor signal if the second sensor signal reaches a third threshold before the first sensor signal reaches an initial first threshold.

12. The device of claim 11, wherein the first hazardous condition sensor comprises a smoke sensor.

13. The device of claim 12, wherein the smoke sensor comprises an ionization smoke sensor.

14. The device of claim 13, wherein the second hazardous condition sensor comprises a carbon monoxide sensor.

15. The device of claim 11, wherein the controller decreases sensitivity to the first sensor signal when the first sensor signal reaches an initial first threshold before the second sensor signal reaches the second threshold.

16. The device of claim 15, wherein the controller causes a first alarm to be generated if (a) the first sensor signal reaches a decreased sensitivity first threshold; or (b) the first sensor signal is at or beyond the initial first threshold at expiration of a timeout period; or (c) after sensitivity to the first sensor signal is decreased, the second sensor signal reaches a third threshold.

17. A detector comprising:

a smoke sensor for producing a smoke sensor signal;

a carbon monoxide (CO) sensor for producing a CO sensor signal; and a controller for generating a smoke sensitive state, smart hush state ,and alarm state, wherein the smoke sensitive state is generated as a function of CO sensed before smoke has been sensed, the smart hush state is generated as a function of smoke sensed before CO has been sensed, and the alarm state is generated if the smoke sensor signal reaches a first smoke threshold in the smoke sensitive state or a second smoke threshold in the smart hush state.

18. The fire detector of claim 17, wherein the controller causes a smoke alarm to be generated if the CO sensor signal reaches a CO threshold before the smoke sensor signal reaches the second smoke threshold.

19. The fire detector of claim 17, wherein the controller causes a smoke alarm to be generated if the smoke sensor signal is at or beyond a third smoke threshold in the smart hush state at expiration of a timeout period.

20. The device of claim 17, wherein the smoke sensor comprises an ionization smoke sensor.

* * * * *